US009474388B2

(12) United States Patent
Goppion

(10) Patent No.: US 9,474,388 B2
(45) Date of Patent: Oct. 25, 2016

(54) SHOWCASE HAVING LOW VISIBILITY OPENING SUPPORT

(71) Applicant: GOPPION S.p.A., Trezzano Sul Naviglio (IT)

(72) Inventor: Alessandro Goppion, Milan (IT)

(73) Assignee: GOPPION S.P.A., Trezzano Sul Naviglio (MI) (IT)

( * ) Notice: Subject to any disclaimer, the term of this patent is extended or adjusted under 35 U.S.C. 154(b) by 0 days.

(21) Appl. No.: 14/265,216

(22) Filed: Apr. 29, 2014

(65) Prior Publication Data

US 2014/0319979 A1 Oct. 30, 2014

(30) Foreign Application Priority Data

Apr. 30, 2013 (IT) ..... MI2013A0711

(51) Int. Cl.
*A47F 3/00* (2006.01)

(52) U.S. Cl.
CPC ..... *A47F 3/002* (2013.01); *A47F 3/005* (2013.01); *A47F 2003/008* (2013.01)

(58) Field of Classification Search
CPC ..... A47F 3/00; A47F 3/002; A47F 3/005; A47F 3/0426; A47F 3/0434; A47F 2003/008
USPC ..... 312/114, 116, 138.1, 139.2, 326, 329
See application file for complete search history.

(56) References Cited

U.S. PATENT DOCUMENTS

| | | | | |
|---|---|---|---|---|
| 810,857 | A * | 1/1906 | Hallock | 312/140 |
| 981,486 | A | 1/1911 | Shaner | |
| 2,753,236 | A | 7/1956 | Spring | |
| 5,069,512 | A * | 12/1991 | Sykes | 312/139.2 |
| 5,558,416 | A * | 9/1996 | Dumitru | 312/139 |
| 6,113,198 | A * | 9/2000 | Hommes | 312/114 |
| 6,398,322 | B1 * | 6/2002 | Chaplin | 312/140 |
| 6,402,270 | B1 * | 6/2002 | Frank | 312/138.1 |
| 6,455,816 | B1 * | 9/2002 | Reddy et al. | 219/400 |
| 6,457,278 | B1 * | 10/2002 | Fleming | 52/37 |
| 6,793,298 | B2 * | 9/2004 | Delph | 312/139.2 |
| 7,090,313 | B1 * | 8/2006 | McMurray | 312/138.1 |
| 8,511,768 | B2 * | 8/2013 | Brachert | 312/405 |
| 2010/0127603 | A1 * | 5/2010 | Hahn | 312/117 |

FOREIGN PATENT DOCUMENTS

| | | | |
|---|---|---|---|
| DE | 29603321 U1 | | 5/1996 |
| FR | 2598188 | | 11/1987 |
| JP | 11-46939 | * | 2/1999 |

OTHER PUBLICATIONS

Italian Search Report issued on Jan. 14, 2014 for MI20130711 which was filed on Apr. 30, 2013.
Italian Written Opinion issued on Jan. 14, 2014 for MI20130711 which was filed on Apr. 30, 2013.

* cited by examiner

*Primary Examiner* — James O Hansen
(74) *Attorney, Agent, or Firm* — Steinfl & Bruno, LLP

(57) ABSTRACT

This showcase for preserving and displaying objects in a protected environment comprises a base, a box made up of fixed side panels and an upper panel connected to each other in a sealing fashion and defining an abutment framework. At least the upper panel is made of glass, same case applying to an openable panel, which can be closed in a sealing fashion on the abutment framework. A lower opening support is fixed between the base and the openable panel, an upper opening support is fixed between the upper panel and the openable panel. The showcase comprises a seat formed in the upper panel, in proximity of the abutment framework and closed towards the outside of the box; in the seat the upper opening support is at least partially encased, in the direction of the thickness of the upper panel, thus being substantially invisible.

10 Claims, 4 Drawing Sheets

SHOWCASE HAVING LOW VISIBILITY OPENING SUPPORT

CROSS REFERENCE TO RELATED APPLICATIONS

The present application is the US national stage of Italian Application No. MI2013A000711 filed on Apr. 30, 2013, which is herein incorporated by reference in its entirety.

FIELD

The present invention refers to a showcase for preserving and displaying objects in a protected environment, such as artworks, cultural heritage objects or delicate objects, in museums, exhibitions and the like.

The expression "protected environment" herein and hereinafter refers to an environment in which the atmosphere is controlled, through the monitoring of one or more parameters from among temperature, relative humidity, dust content, pollutant content, with the aim of maintaining the conditions provided for preserving the displayed objects, and in which access thereto by unauthorised personnel is prohibited, so as to avoid theft or damage of the displayed objects.

BACKGROUND

Thus, showcases of this type must meet various types of requirements, as regards the preservation and entirety of the displayed objects. In addition, obviously, these showcases are required to guarantee the best visibility for the displayed objects.

With the aim of improving visibility, manufacturers of showcases try as much as possible to use transparent material—typically glass—for the walls of the showcases. Besides guaranteeing better visibility of the displayed objects, the extensive use of glass is often desired by the designers of showcases due to the fact that the transparency of the material allows of heightening the visibility of the displayed objects to the maximum.

Thus, showcases with a base surmounted by a box made up of panels are developed; the base houses all the technical components required for guaranteeing that the environment inside the box is protected and thus normally closed by non-transparent walls, which conceal all the technical components; vice versa, the walls of the box are entirely or partially made of glass, for the aforementioned reasons.

The possibility of access into the box, for housing, removal or maintenance of the displayed objects, is normally obtained by providing for that one of the side panels be openable. For such purpose, opening supports of various types are used, which allow the opening by rotation or roto-translation of the panel (more or less complex hinges) or by sliding (sliding guides). Inevitably, these supports cannot be made of transparent material, for robustness reasons, and thus they are made of metal, thus being visible. At the lower part, the opening supports may be easily housed in the base, but at the upper part they are more or less visible between the upper panel and the openable panel. Hence, these supports often jeopardise the efforts of the designers as regards the maximum transparency of the materials; in particular, in the case of showcases wherein the box is made of panels entirely made of glass, the opening supports risk to have a visibility almost comparable to that of the objects displayed in the showcase.

Thus, the problem of making the opening supports the least visible possible arises, though in case of panels made of transparent material.

SUMMARY

Hence, the present invention regards a showcase as defined in claim 1. Preferred characteristics are indicated in the dependent claims.

In particular, the invention regards a showcase for preserving and displaying objects in a protected environment, comprising a base, a box made up of fixed side panels and an upper panel connected to each other in a sealing fashion and defining an abutment framework, at least the upper panel being made of transparent material, an openable panel also made of transparent material, which can be closed in a sealing fashion on said abutment framework, a lower opening support fixed between the base and the openable panel, an upper opening support fixed between the upper panel and the openable panel, characterised in that it comprises a seat formed in the upper panel, in proximity of the abutment framework and closed towards the outside of the box, the upper opening support being at least partially encased in the seat, in the direction of the thickness of the upper panel.

The encased position in the thickness of the upper panel makes the visibility of the upper opening support minimal. Actually, due to the refraction index of the glass, the greater opening support housed encased in the seat is visible from the top, through the thickness of the upper panel, but much less from the side, in the typical direction of observation of the showcase. In addition, the orientation of the seat so that it is closed towards the outside of the box of the showcase prevents access to the opening support with the showcase closed; this characteristic contributes to the safety of the showcase, thus hindering any tampering with the opening support.

Preferably, the upper opening support is encased in the seat for at least 80%, in the direction of the thickness of the upper panel, and even more preferably it is completely encased in the seat, in the direction of the thickness of the upper panel. The more the opening support is encased, the less visible it is laterally.

Preferably, also the side panels adjacent to the abutment framework are made of transparent material. Actually, the low visibility of the upper opening support allows to extend the use of the transparent material to all panels of the box, without the latter risking exposing the opening support; hence, the showcase provides maximum visibility to the displayed objects, substantially without interfering with the upper opening support.

Preferably, the seat is formed by milling or analogous chip removal machining, extending for part of the thickness of the upper panel. Choosing a suitable thickness for the upper panel, easily allows to maintain the required mechanical resistance of the panel though in the presence of the encased seat.

The upper panel may be obtained by coupling two slabs, the seat extending for the entire thickness of the slab of the upper panel facing towards the inside of the box. Thus, the seat is easy to obtain.

Preferably, the upper opening support is fixed to the upper panel through gluing in the seat. The gluing, obtained with the bonding agent most suitable for the specific materials, allows to firmly fix the support without requiring visible accessory elements, such as screws or the like.

In a preferred embodiment, the opening supports are an upper hinge and a lower hinge. More preferably, the upper hinge comprises a fixed element, fixed inside the seat in the upper panel of the box, a mobile element, fixed to the openable panel, a first connecting rod and a second connecting rod hinged between the fixed element and the mobile element so as to obtain an articulated quadrilateral adapted to cause a roto-translation of the mobile element with respect to the fixed element between an open position and a closed position of the hinge.

In an alternative embodiment, the opening supports are sliding guides.

BRIEF DESCRIPTION OF THE DRAWINGS

Further characteristics and advantages of a showcase according to the invention shall be more apparent from the following description of a preferred embodiment thereof, provided with reference to the attached drawings, wherein.

DESCRIPTION

Figure 1:
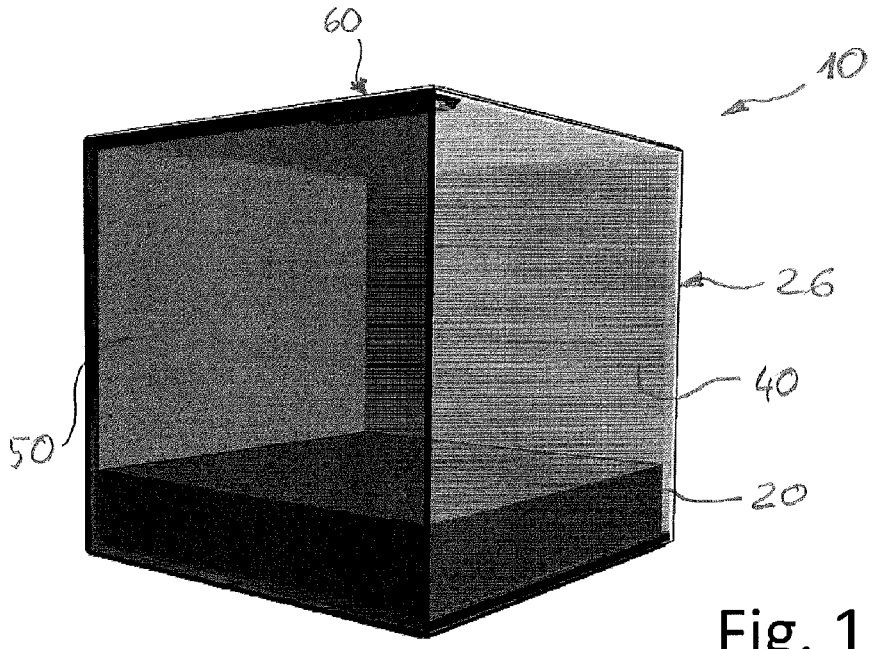
FIG. 1 is a perspective view of a showcase according to the invention.

In the figure, the showcase according to the invention is indicated in its entirety with 10. The showcase 10 comprises a base 20, surmounted by a box 26 made up of an upper panel 30 and side panels; in the illustrated example, the showcase 10 is substantially parallelepiped-shaped and thus there are four side panels; of these, three side panels 40 are fixed and one side panel 50 is openable.

The upper panel 30, the fixed side panels 40 and the openable panel 50 are formed by coupling two external and internal slabs, indicated with 31, 32 in the upper panel 30, with 41, 42 in the fixed side panels 40 and with 51, 52 in the openable panel 50. The slabs of each panel are transparent, made of glass or the like, and they are coupled to each other through a suitable intermediate material, also transparent, respectively indicated with 33, 43, 53, according to the techniques known in the art, so as to be integral with respect to each other.

Figure 2:
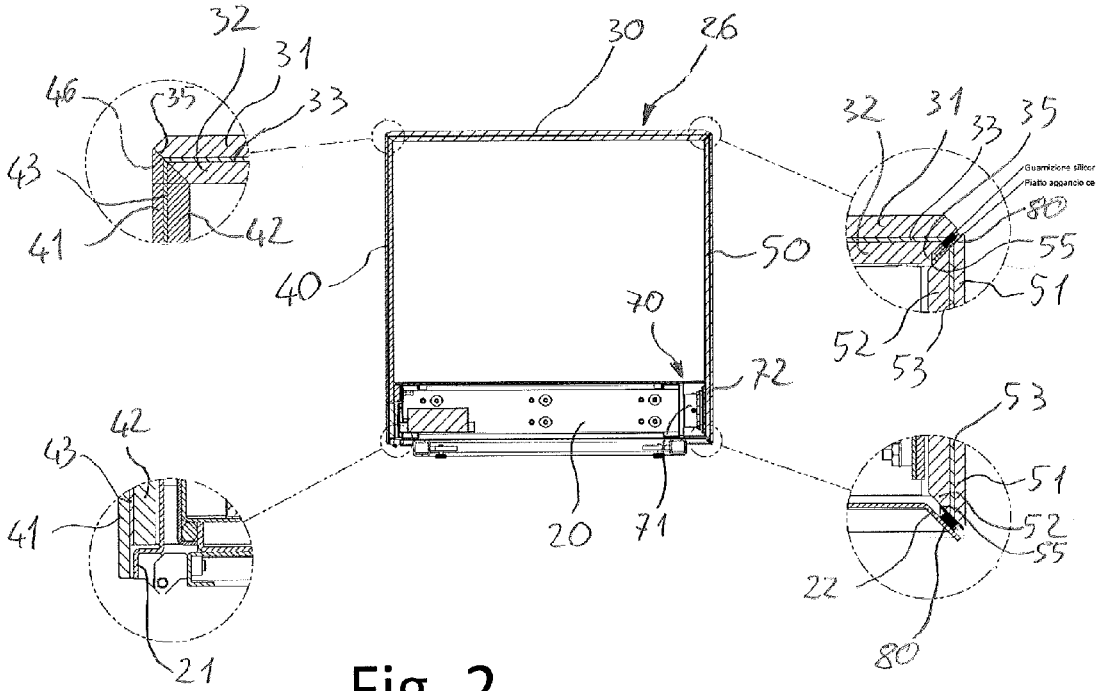
FIG. 2 is a vertical sectional view of the showcase of FIG. 1, with some details in enlarged scale.
Figure 3:
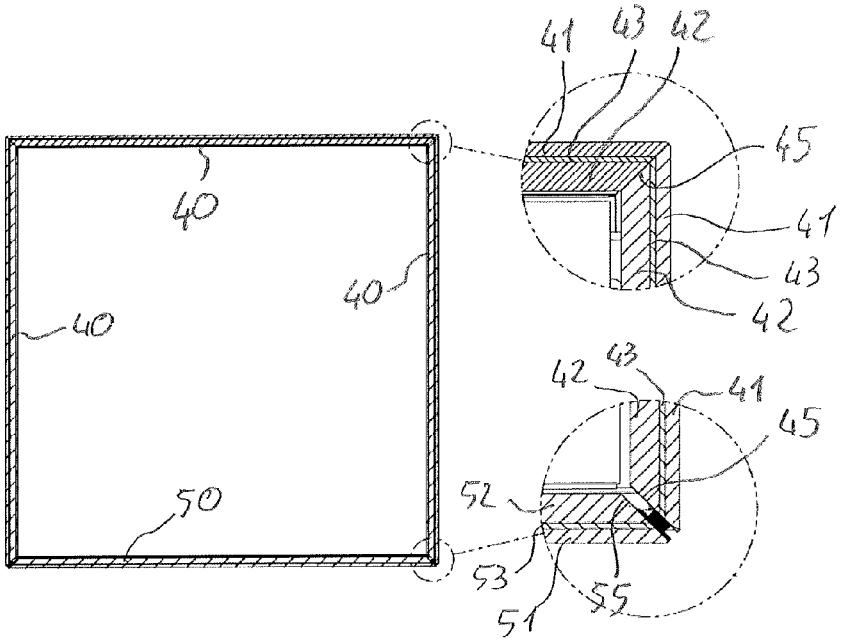
FIG. 3 is a horizontal sectional view of the showcase of FIG. 1, with some details in enlarged scale.

The fixed side panels 40 are then welded to form the box 26. More precisely, the fixed side panels 40 are welded to each other along lateral edges 45, cut in an oblique fashion at 45° as observable in FIG. 3. In addition, the fixed side panels 40 are welded along their upper edges 46, cut in an oblique fashion at 45° as observable in FIG. 2, at corresponding edges 35, cut in an oblique fashion at 45° as observable in FIG. 3, of the upper panel 30. Lastly, the fixed side panels 40 are welded to a lower support structure 21 of the base 20; more precisely, the structure 21 provides for a step-shaped element, so as to offer extensive support to every panel 40 in the area below it, where the external slab 41 is more extended downwards with respect to the internal slab 42, as clearly observable in FIG. 2.

The openable panel 50 has all its four edges 55 cut at 45°, so that the assembly of such four edges 55 forms an abutment surface. Correspondingly, the edges 45 and 35 of the fixed 40 and upper 30 side panels, also cut in an oblique fashion at 45°, together with an abutment element 22, also inclined in an oblique fashion 45° and provided in the base 20 (see FIG. 2), form an abutment framework.

The openable panel 50 is supported and guided for the opening and closing movements thereof by an upper opening support and a lower opening support; in the illustrated example, the upper opening support is formed by an upper hinge 60 and the lower opening support is formed by a lower hinge 70; in other embodiments, instead of the hinge a sliding system may be provided, wherein the upper opening support is a mechanism for supporting and/or extracting a sliding guide.

Figure 4:
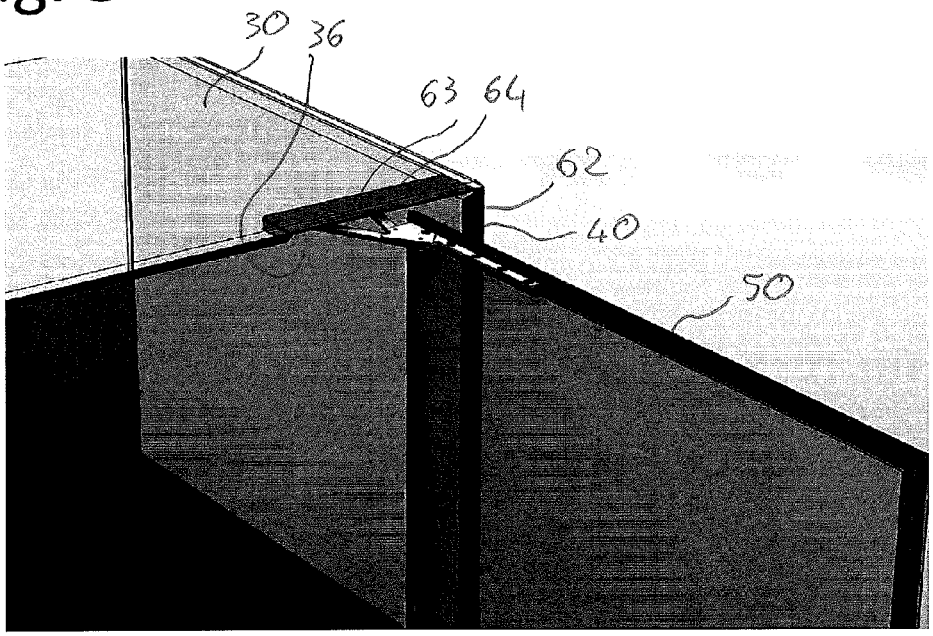
FIG. 4 is a top perspective view of the showcase of FIG. 1, with the openable panel in open position.
Figure 5:
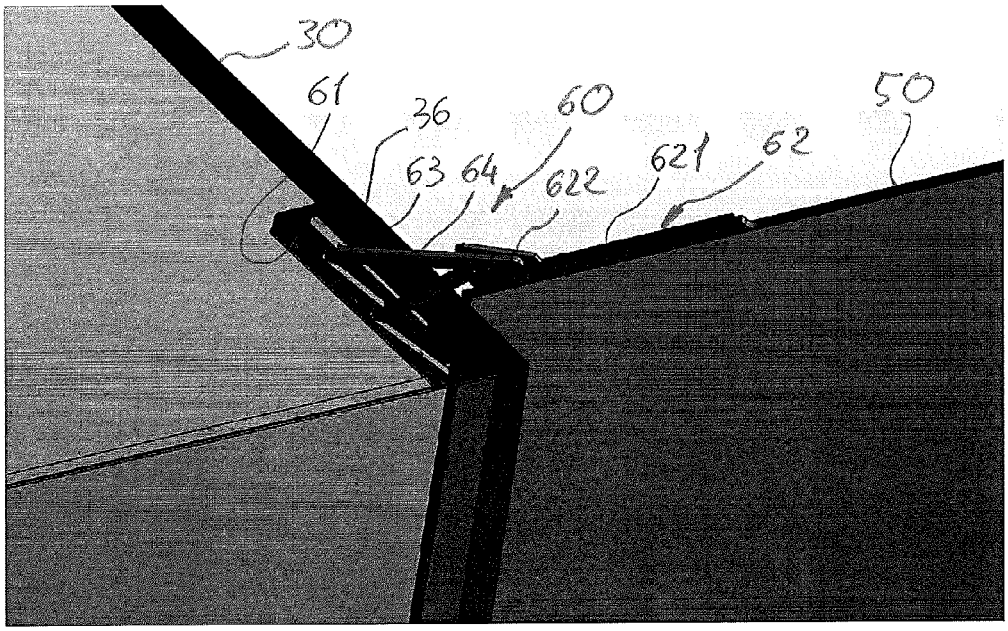
FIG. 5 is a bottom perspective view of a detail of the showcase of FIG. 1, with the openable panel in open position.
Figure 6:
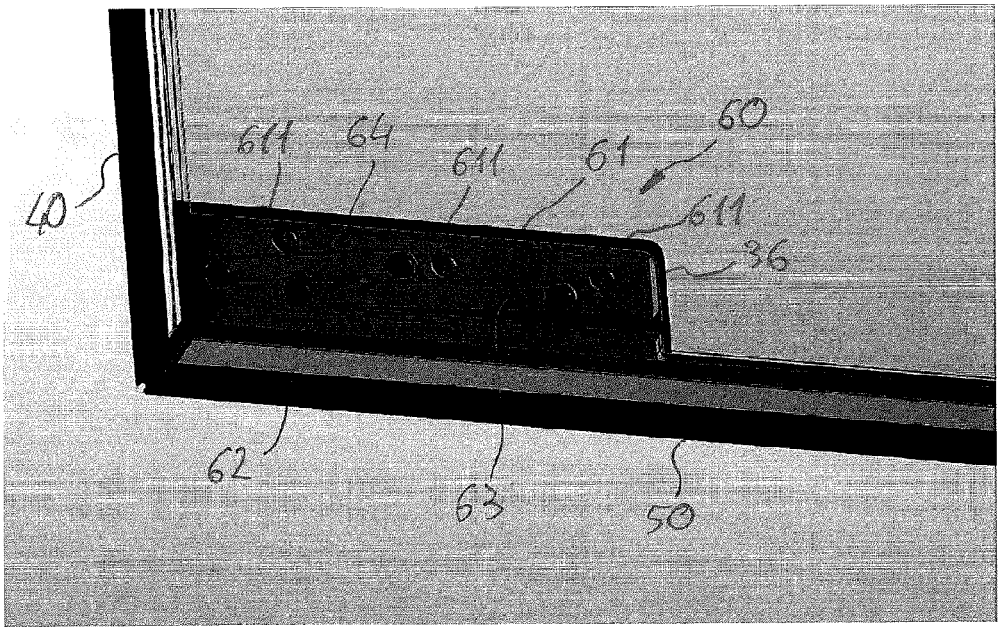
FIG. 6 is a top perspective view of the showcase of FIG. 1, with the openable panel in closed position.
Figure 7:
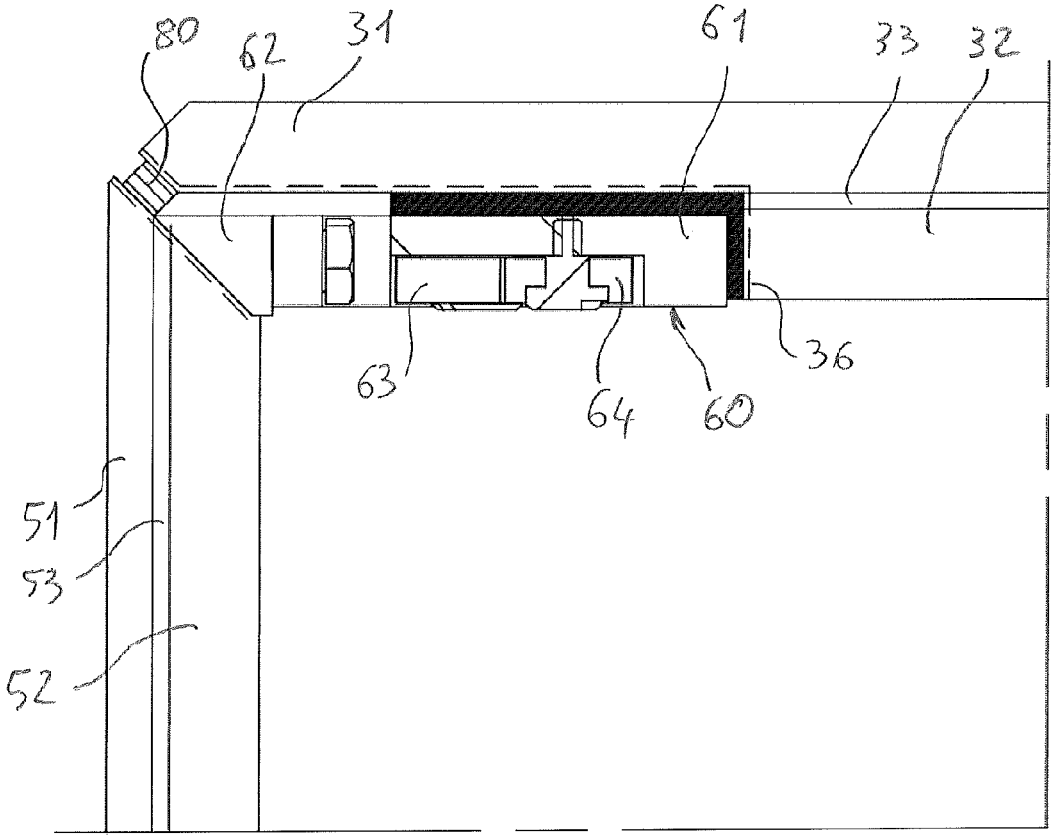
FIG. 7 is a vertical sectional view of the showcase of FIG. 1, in at the upper opening support.

The upper hinge 60 comprises a fixed element 61 and a mobile element 62, interconnected to each other through two connecting rods 63 and 64 so as to obtain an articulated quadrilateral adapted to cause a roto-translation of the mobile element 62 with respect to the fixed element 61 between an open position (shown in FIGS. 4 and 5) and a closed position (shown in FIG. 6).

The mobile element 62 comprises a lath 621, glued to the openable panel 50, and a bracket 622, fixed to the lath 621; the connecting rods 63 and 64 are hinged to this bracket 622. The fixed element 61 is glued to the upper panel 30 inside a seat encased 36, formed in proximity of the edge 35 by milling or analogous mechanical machining, open towards the openable panel 50 and towards the inside of the box 20. The seat 36 involves, in the direction of the thickness of the upper panel 30, the entire inner slab 42 and the upper hinge 60 is almost entirely encased in this seat 36, as observable in FIG. 2. In an embodiment (not illustrated), the upper hinge 60 could be entirely encased in the seat 36, in the direction of the thickness of the upper panel 30.

The gluing of the fixed element 61 in the seat 36 may advantageously occur both on the upper wall of the seat 36 (thus against the external slab 41), and on the bottom wall of the seat 36 (thus against the internal slab 42). Additionally or alternatively to the gluing, screws 611 may be provided for fixing the fixed element 61 to the external slab 41, on the upper wall of the seat 36.

The lower hinge 70 obviously has a mechanism corresponding to that of the upper hinge 60 and thus it comprises a fixed element 71 mounted integral to the base 20 (for example through screws and bolts, not shown in the figures) and a mobile element 72 mounted integral to the openable panel 50 (for example by gluing); the two fixed 71 and mobile 72 elements are interconnected to each other by means of connecting rods (not shown in the figures).

Lastly, a sealing gasket 80 is advantageously interposed between the fixed abutment framework, made up of the edges 45, 35 and the element 25, and the mobile abutment surface, made up of edges 55 of the openable panel 50.

As observable, in the showcase 10 the hinges 60 and 70 are substantially invisible, though the entire box 26 of the showcase 10 is transparent. Actually, the upper hinge 60 is arranged so that the visibility thereof is extremely low, being almost entirely encased in the seat 36; in addition, due to the high refraction index of the glass, looking at the showcase 10 laterally, it is extremely difficult to notice the presence of the hinge 60. The hinge 60 can be seen by the observer only looking from above, the latter being an unusual occurrence in a display space. In any case, also in a top view, the presence of the hinge 60 is certainly not very invasive with respect to the showcase 10 and the objects displayed therein.

The invention claimed is:

1. Case for preserving and displaying objects in a protected environment, comprising:

a base;

a seat;

fixed side panels having edges cut obliquely at an angle;

an upper panel having edges cut obliquely at an angle;

an openable panel having edges cut obliquely at an angle;

a lower opening support; and an upper opening support, wherein the edges of the fixed side panels and the upper panel define abutted edges of a box formed from the fixed side panels and the upper panel connected together in a sealed fashion along the abutted edges, the box being devoid of any framing elements, wherein the upper panel is made from transparent material, wherein the openable panel is made from transparent material, and is able to close in a sealed fashion on said abutted edges along the edges of the openable panel, wherein the lower opening support is fixed between the base and the openable panel, wherein the upper opening support is fixed between the upper panel and the openable panel, and wherein the seat is formed in the upper panel, close to at least one of the abutted edges and is closed towards the outside of the box, in which the upper opening support is encased in the seat, in the direction of a thickness of the upper panel.

2. Case according to claim 1, wherein the side panels adjacent to the abutted edges are also made from transparent material.

3. Case according to claim 1, wherein the seat is formed by milling or analogous chip removal machining, extending for a part of the thickness of the upper panel.

4. Case according to claim 1, wherein the upper panel is obtained by coupling an upper slab to a lower slab along adjacent surfaces of the upper slab and the lower slab, the seat extending for the entire thickness of the lower slab, the lower slab facing towards the inside of the box.

5. Case according to claim 1, wherein the upper opening support is fixed to the upper panel through gluing in the seat.

6. Case according to claim 1, wherein the opening supports are an upper hinge and a lower hinge.

7. Case according to claim 6, wherein the upper hinge comprises a fixed element, fixed inside the seat in the upper panel of the box, a mobile element, fixed to the openable panel, a first connecting rod and a second connecting rod hinged between the fixed element and the mobile element so as to obtain an articulated quadrilateral suitable for causing a rotational translation of the mobile element with respect to the fixed element between an open position and a closed position of the hinge.

8. Case according to claim 1, wherein the angle of the fixed side panels, the upper panel and the openable panel is 45°.

9. Case according to claim 1, wherein each of the side panels is obtained by coupling an external slab to an internal slab along adjacent surfaces of the external slab and the internal slab, the external slab being more extended downwards with respect to the internal slab.

10. Case according to claim 9, wherein each of the side panels rest on a respective lower support structure of the base solely by way of a flat edge surface of the internal slab.

* * * * *